US008646633B2

(12) United States Patent
Huntington et al.

(10) Patent No.: US 8,646,633 B2
(45) Date of Patent: Feb. 11, 2014

(54) CLOSURE FOR CONTAINERS OF OPHTHALMIC SOLUTIONS CONTAINING A SPOUT CAP

(75) Inventors: Elysha Huntington, Jersey City, NJ (US); Richard Tanaka, Astoria, NY (US); Anthony Yumul, New York, NY (US)

(73) Assignee: Johnson & Johnson Vision Care Inc, Jacksonville, FL (US)

( * ) Notice: Subject to any disclaimer, the term of this patent is extended or adjusted under 35 U.S.C. 154(b) by 209 days.

(21) Appl. No.: 12/967,822

(22) Filed: Dec. 14, 2010

(65) Prior Publication Data

US 2011/0220673 A1 Sep. 15, 2011

Related U.S. Application Data

(60) Provisional application No. 61/286,937, filed on Dec. 16, 2009.

(51) Int. Cl.

| | |
|---|---|
| ***B65D 47/08*** | (2006.01) |
| ***B65D 47/20*** | (2006.01) |
| ***B65D 51/04*** | (2006.01) |
| ***B65D 41/62*** | (2006.01) |
| *B65D 41/46* | (2006.01) |

(52) U.S. Cl.
USPC ..... 215/237; 215/235; 220/834; 220/836; 222/556

(58) Field of Classification Search
USPC ..... 215/235–237, 250, 251, 253, 258; 220/833–837; 222/556
See application file for complete search history.

(56) References Cited

U.S. PATENT DOCUMENTS

| | | | | | |
|---|---|---|---|---|---|
| 2,630,239 | A | * | 3/1953 | Paull et al. | 220/254.3 |
| 3,741,447 | A | * | 6/1973 | Miles et al. | 222/517 |
| 3,877,598 | A | * | 4/1975 | Hazard | 215/224 |
| 3,986,627 | A | * | 10/1976 | Zapp | 215/237 |
| 4,193,519 | A | * | 3/1980 | Dubach et al. | 222/111 |
| 4,911,324 | A | | 3/1990 | Dubach | |
| 5,207,657 | A | * | 5/1993 | Gibilisco | 604/295 |
| 5,320,235 | A | * | 6/1994 | Joyce | 215/254 |
| 5,386,918 | A | * | 2/1995 | Neveras et al. | 215/235 |
| D370,845 | S | * | 6/1996 | Sherman et al. | D9/438 |

(Continued)

FOREIGN PATENT DOCUMENTS

| | | | |
|---|---|---|---|
| EP | 0309396 | B1 | 8/1988 |
| WO | WO 99/59886 | A1 | 11/1999 |
| WO | WO 00/54622 | A1 | 9/2000 |
| WO | WO 2005/039660 | A2 | 5/2005 |

*Primary Examiner* — J. Gregory Pickettt
*Assistant Examiner* — Ned A Walker

(57) ABSTRACT

This invention includes a closure for covering a container. The closure has a base with an upper surface and a neck, with the neck capable of being fastened to the opening of a bottle. The upper surface sits above the opening of the bottle. It has a spout having an exposed front surface, a front inside surface, and a cap rim. The cap is pivotally attached to the base to permit movement of the cap relative to the base between an open position and a closed position. The exposed front surface and front inside surface together have a bottom end and a top end. The inside front surface contains a spout cap, such that when the cap is closed the spout cap mates with the spout to form a liquid tight seal, and such that when the cap is opened the liquid tight seal between the spout and the spout cap is opened.

4 Claims, 5 Drawing Sheets

(56) References Cited

U.S. PATENT DOCUMENTS

| | | | | | |
|---|---|---|---|---|---|
| 5,531,349 | A * | 7/1996 | Wojcik et al. | 220/838 |
| 5,547,091 | A * | 8/1996 | Neveras et al. | 215/237 |
| D374,399 | S * | 10/1996 | Neveras et al. | D9/447 |
| 5,573,127 | A * | 11/1996 | Takahashi et al. | 215/237 |
| 5,755,352 | A * | 5/1998 | Wojcik et al. | 220/838 |
| D400,798 | S * | 11/1998 | Maus | D9/558 |
| D402,202 | S * | 12/1998 | Sherman et al. | D9/446 |
| D404,915 | S * | 2/1999 | Kornick et al. | D3/264 |
| D406,533 | S * | 3/1999 | Maus | D9/558 |
| 5,996,859 | A * | 12/1999 | Beck | 222/556 |
| 6,050,434 | A * | 4/2000 | McNab | 215/235 |
| 6,073,757 | A * | 6/2000 | Kornick et al. | 206/5.1 |
| D440,494 | S * | 4/2001 | Sagel et al. | D9/450 |
| 6,289,906 | B1 * | 9/2001 | Vanden Dries et al. | 134/117 |
| 6,536,453 | B2 * | 3/2003 | Vanden Dries et al. | 134/117 |
| D547,184 | S * | 7/2007 | Kim et al. | D9/449 |
| 7,328,788 | B2 * | 2/2008 | Mahieu et al. | 206/5.1 |
| 7,510,095 | B2 * | 3/2009 | Comeau et al. | 215/321 |
| 7,540,376 | B2 * | 6/2009 | Mahieu et al. | 206/5.1 |
| 7,798,348 | B2 * | 9/2010 | Sawyer | 215/237 |
| 7,861,873 | B1 * | 1/2011 | Bragg et al. | 215/237 |
| D632,574 | S * | 2/2011 | Huntington et al. | D9/504 |
| 8,043,269 | B2 | 10/2011 | Fourment et al. | |
| 8,292,101 | B1 * | 10/2012 | Bragg et al. | 215/237 |
| 2002/0020437 | A1 * | 2/2002 | Vanden Dries et al. | 134/117 |
| 2002/0066755 | A1 * | 6/2002 | Garibaldi | 222/524 |
| 2003/0057209 | A1 * | 3/2003 | Seelhofer | 220/259.1 |
| 2003/0062369 | A1 * | 4/2003 | Hierzer et al. | 220/259.1 |
| 2004/0069806 | A1 * | 4/2004 | Benoit-Gonin et al. | 222/153.06 |
| 2005/0087453 | A1 * | 4/2005 | Mahieu et al. | 206/5.1 |
| 2005/0087455 | A1 * | 4/2005 | Mahieu et al. | 206/216 |
| 2007/0221688 | A1 * | 9/2007 | Fourment et al. | 222/544 |

* cited by examiner

FIG. 4
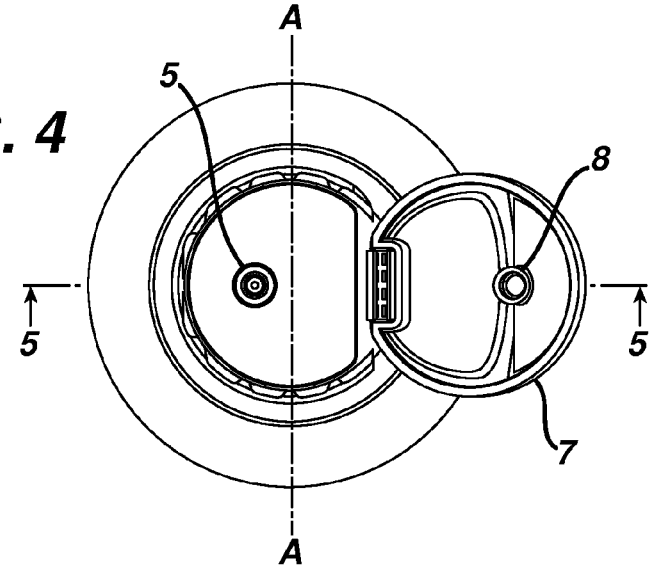
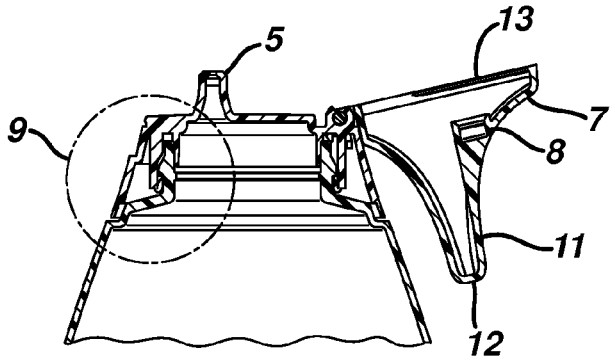
FIG. 5
FIG. 6
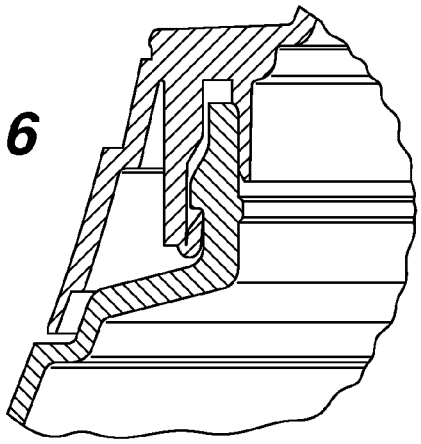

CLOSURE FOR CONTAINERS OF OPHTHALMIC SOLUTIONS CONTAINING A SPOUT CAP

RELATED APPLICATIONS

This application claims priority from a non-provisional filing, U.S. patent application Ser. No. 61/286,937 which was filed on Dec. 16, 2009.

FIELD OF THE INVENTION

This invention relates to designs that are used to close containers of ophthalmic solutions and methods of using the same.

BACKGROUND

Ophthalmic lenses are extremely popular with consumers, particular the soft contact lenses that are either daily disposable or reusable. There are a variety of solutions that are used provide additional comfort to lens wearers when the lenses are in the eye or when the lenses are removed from the eye for cleaning. Most of these solutions are dispensed to the consumer in multiple use bottles that will be opened and reused over time. Given that these solutions are in contact with the eye, the solutions are sterilized to prevent harmful environmental contaminants such as bacteria, viruses, and the like from infecting the patient. However, with a multiple use bottle, these bottles are opened by the consumer and therefore, the consumer's use of the bottle often introduces such contaminants to the solutions. For example commonly used bottles for contact lens solutions have a short cap which covers the spout from which solutions are dispensed. When consumers open these bottles, their fingers often brush across the spout of the bottle and the material on their hands is a source of contamination for the solutions It would be useful if there was a closure which could be used that inhibits consumers from touching the spouts of bottles when opening or closing said bottles. This need is met by the following invention.

BRIEF DESCRIPTION OF THE DRAWINGS

FIG. 4 Top plan view of the closure on a bottle in the open position

FIG. 5 is a cross section of the bottle of FIG. 4, taken along lines A-A.

FIG. 6 is an expanded view of FIG. 5.

DETAILED DESCRIPTION OF THE INVENTION

This invention includes a closure for covering a container comprising a base comprising an upper surface and a neck, wherein said neck is adapted to be fastened to the opening of a bottle and said upper surface sits above the opening of a bottle and is attached to said neck wherein said upper surface comprises a spout cap comprising an exposed front surface, an front inside surface, and a cap rim wherein said cap is pivotally attached to said base to permit movement of the cap relative to the base between a open position and a closed position wherein each of said exposed front surface and said front inside surface comprises a bottom end and a top end wherein said bottom end of said exposed front surface and said inside surface are located closer to the upper surface when the bottle is in the closed position and the top end is located further away from the upper surface when the bottle is in the closed position wherein said inside front surface comprises a spout cap wherein when said cap is closed the spout cap mates with said spout to form a liquid tight seal wherein when said cap is opened the liquid tight seal between the spout and the spout cap is opened.

Figure 1:
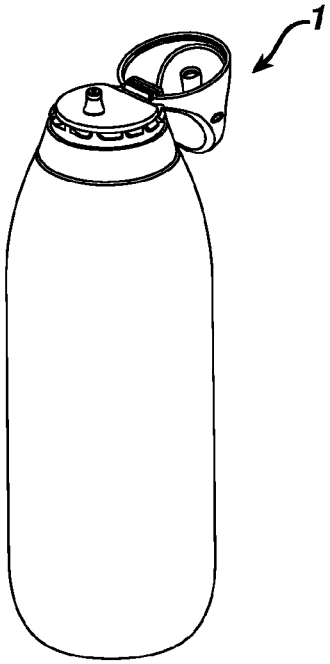
FIG. 1 Perspective view of a closure of the invention on a bottle
Figure 2:
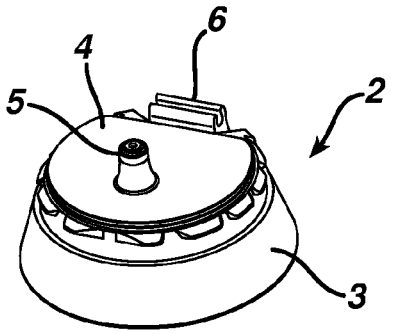
FIG. 2 Perspective view of the base
Figure 3:
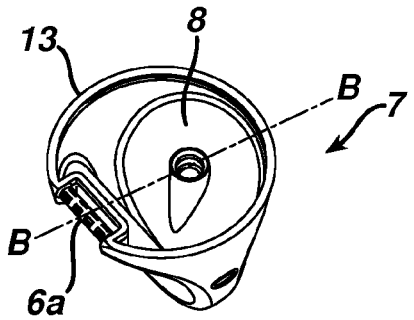
FIG. 3 Perspective view of the inside of the cap
Figure 7:
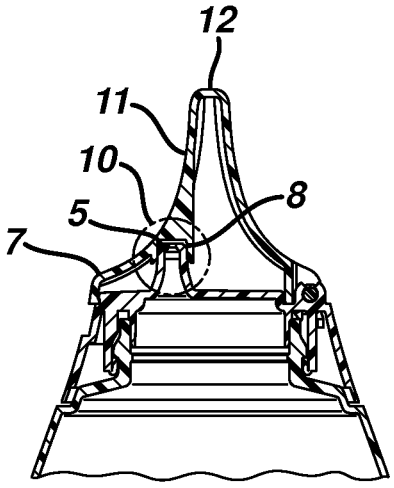
FIG. 7. Cross-section view of the closure on a bottle in the closed position.
Figure 8:
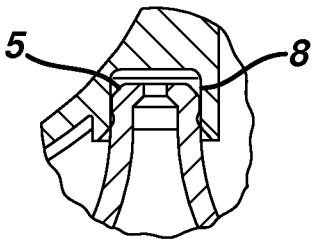
FIG. 8 Expanded view of FIG. 7

The following figures illustrate an embodiment of the invention. FIG. 1 illustrates a perspective view of a closure 1 of the invention attached to a bottle. FIG. 2 illustrates a perspective view of base 2, neck 3 upper surface 4 and spout 5 and hinge 6. FIG. 3 illustrates cap 7, spout cap 8, and rim 13. The cap may be connected to the base by a number of hinging methods including interlocking hinges and living hinges. FIG. 4. Illustrates a top plan views of closure 1 on a bottle in the open position. Spout cap 8 and spout 5 line up along line 5-5. The center of spout 5 is located 5.0 mm from line A-A. Spout cap FIG. 5 shows a cross-sectional view along line A-A illustrating the interconnection of neck 3 with the neck of the bottle in the circled area 9. Angled exposed front surface 11, is illustrated angling from rim 13 to apex 12. It is preferred that exposed front surface 11 is angled to permit a user's thumb to rest against the such front surface 11 when said bottle is grasped in the same hand. The top of the cap is slightly rounded and apex 12 is the geometric centerpoint of the top of the cap. The height of the cap from rim 13 to apex 12 is 28.42 mm. The partial diameter of rim 13 measured from the circumference of rim 13 to the midpoint of hinge 6 as position 6*a*, along line B-B is 26.4 mm. FIG. 6 illustrates a more detailed view of circled area 9. FIG. 7 illustrates cross-sectional view along line 5 of closure 1 in the closed position where the mating of spout 5 and spout cap 8 are appear in circle 10 FIG. 8 illustrates a more detailed view of circle. The mating of this area is a snap fit where spout cap 8 fits over spout 5 However, this mating may be accomplished by a number of methods including, pressure fits.

The foregoing closures may be made by a variety of plastic materials such as without limitation, ethylene vinyl alcohol ("EVA"), fluorinated polymers including without limitation, polytetrafluoroethylene ("PTFE") and polyvinylidene fluoride ("PVDF"), polypropylene, polyethylene, polyisobutylene, nylon, polyurethanes, polyacrylates and methacrylates, polyvinyl palmitate, polyvinyl stearates, polyvinyl myristate, cyanoacrylates, epoxies, silicones, copolymers thereof. The closure is preferably made of polypropylene. Each piece of the closure may be made of a different material or the same material. Any of these pieces may be made of unitary construction with or without the bottle. In the preferred embodiment all pieces of the closure are made of the same material. Any or all of the components of the closure may be made by injection molding (two material injection molding, overmolding, sandwich molding or insert molding). Other combinations of materials and construction methods are known to those of skill in the art of molding plastic materials and although such materials and methods are not specifically mentioned herein they are considered to be included in this invention.

Further the invention includes a closure for covering a container comprising a base comprising an upper surface and a neck, wherein said neck is adapted to be fastened to the opening of a bottle and said upper surface sits above the opening of a bottle and is attached to said neck wherein said upper surface comprises a spout cap comprising an angled exposed front surface, an angled front inside surface, an apex, and a cap rim wherein said cap is pivotally attached to said base to permit movement of the cap relative to the base between a open position and a closed position wherein each of said exposed front surface and said angled front inside surface comprises a bottom end and a top end wherein the angled exposed front surface sits at an angle from the cap rim at bottom end towards the apex at the top end wherein the angled exposed inside surface sits at an angle from the cap rim at bottom end towards the apex at the top end and said angled exposed inside surface comprises a spout cap wherein when said cap is closed the spout cap mates with said spout to form a liquid tight seal wherein when said cap is opened the liquid tight seal between the spout and the spout cap is broken.

Still further, the invention includes a method of storing an ophthalmic lens solution in a bottle comprising a closure which comprises a base comprising an upper surface and a neck, wherein said neck is adapted to be fastened to the opening of a bottle and said upper surface sits above the opening of a bottle and is attached to said neck wherein said upper surface comprises a spout cap comprising an exposed front surface, an front inside surface, and a cap rim wherein said cap is pivotally attached to said base to permit movement of the cap relative to the base between a open position and a closed position wherein each of said exposed front surface and said front inside surface comprises a bottom end and a top end wherein said bottom end of said exposed front surface and said inside surface are located closer to the upper surface when the bottle is in the closed position and the top end is located further away from the upper surface when the bottle is in the closed position wherein said inside front surface comprises a spout cap wherein when said cap is closed the spout cap mates with said spout to form a liquid tight seal wherein when said cap is opened the liquid tight seal between the spout and the spout cap is opened.

Yet further still, the invention includes a method of storing an ophthalmic lens solution in bottle comprising a closure which comprises base comprising an upper surface and a neck, wherein said neck is adapted to be fastened to the opening of a bottle and said upper surface sits above the opening of a bottle and is attached to said neck wherein said upper surface comprises a spout cap comprising an angled exposed front surface, an angled front inside surface, an apex, and a cap rim wherein said cap is pivotally attached to said base to permit movement of the cap relative to the base between a open position and a closed position wherein each of said exposed front surface and said angled front inside surface comprises a bottom end and a top end wherein the angled exposed front surface sits at an angle from the cap rim at bottom end towards the apex at the top end wherein the angled exposed inside surface sits at an angle from the cap rim at bottom end towards the apex at the top end and said angled exposed inside surface comprises a spout cap wherein when said cap is closed the spout cap mates with said spout to form a liquid tight seal wherein when said cap is opened the liquid tight seal between the spout and the spout cap is broken.

The aforementioned terms all have their stated meanings and preferred ranges or components. The term "ophthalmic lens solution" means any solution that is used to clean, maintain, or lubricate ophthalmic lenses or the eye of a user of such lenses whether or not such lenses are in the user's eye. Examples of such solutions include any composition which can be directly instilled into an eye, or which can be used to soak, clean, rinse, store or treat any ophthalmic device which can be used placed in or on the eye. Examples of ophthalmic compositions that may be topically administered to the eye, ophthalmic device packing solutions, cleaning solutions, conditioning solutions, storage solutions, eye drops, eye washes, as well as ophthalmic suspensions, aerosols, gels and ointments and the like. In one embodiment of the present invention, the ophthalmic composition is a multipurpose lens care solution. The multipurpose lens care solution may contain a disinfectant. The disinfecting agent should not cause stinging or damage to the eye at use concentrations and should be inert with respect to the other composition components. Suitable disinfecting components include hydrogen peroxide, polymeric biguanides, polymeric quarternary ammonium compounds, chlorites, bisbiguanides, quarternary ammonium compounds and mixtures thereof. The multipurpose lens care solution may also contain one or more lubricating agents may also be included in the ophthalmic composition. Lubricating agents include water soluble cellulosic compounds, hyaluronic acid, and hyaluronic acid derivatives, chitosan, water soluble organic polymers, including water soluble polyurethanes, polyethylene glycols, combinations thereof and the like. Specific examples of suitable lubricating agents include polyvinyl pyrrolidone ("PVP"), hydroxypropyl methyl cellulose, carboxymethyl cellulose, glycerol, propylene glycol, 1,3-propanediol, polyethylene glycols, mixtures there of and the like. The multipurpose lens care solution may also contain one or more surfactant, detergent, or mixtures thereof. Suitable examples include tyloxapol, poloxomer (poly(ethylene oxide)-b-poly(propylene oxide)-b-poly(ethylene oxide)) type surfactants which are commercially available from BASF and poloxamine type surfactants (non-ionic, tetrafunctional block copolymers based on ethylene oxide/propylene oxide, terminating in primary hydroxyl groups, commercially available from BASF, under the tradename Tetronic). A specific example is Pluronic F-147 and Tetronic 1304. Tyloxapol is a non-ionic, low molecular weight surfactant, and is fully soluble in the phosphate buffers. Tyloxapol is a detergent commercially available from Pressure Chemical Company. The multipurpose lens care solution may also contain one or more viscosity adjusting agent or thickener. Suitable viscosity adjusting agents are known in the art and include polyvinyl alcohol, polyethylene glycols, guar gum, combinations thereof and the like. The viscosity adjusting agent may be used in amounts necessary to achieve the desired viscosity. The multipurpose lens care solution may further comprise additional components such as, but not limited to pH adjusting agents, tonicity adjusting agents, buffering agents, active agents, lubricating agents, disinfecting agents, viscosity adjusting agents, surfactants and mixtures thereof. When the ophthalmic composition is an ophthalmic solution, all components in the ophthalmic solution of the present invention should be water soluble. As used herein, water soluble means that the components, either alone or in combination with other components, do not form precipitates or gel particles visible to the human eye at the concentrations selected and across the temperatures and pH regimes common for manufacturing, sterilizing and storing the ophthalmic composition.

The multipurpose lens care solution may also contain one or more active agent. A wide variety of therapeutic agents may be used, so long as the selected active agent is inert in the presence of peroxides. Suitable therapeutic agents include those that treat or target any part of the ocular environment, including the anterior and posterior sections of the eye and include pharmaceutical agents, vitamins, nutraceuticals combinations thereof and the like. Suitable classes of active agents include antihistamines, antibiotics, glaucoma medication, carbonic anhydrase inhibitors, anti-viral agents, anti-inflammatory agents, non-steroid anti-inflammatory drugs, antifungal drugs, anesthetic agents, miotics, mydriatics, immunosuppressive agents, antiparasitic drugs, anti-protozoal drugs, combinations thereof and the like. When active agents are included, they are included in an amount sufficient to produce the desired therapeutic result (a "therapeutically effective amount").

The advantages of the invention are many. For example, users of containers of ophthalmic lens solutions which are closed with the closures of the invention are substantially inhibited from touching the spout of such closures upon opening such containers. This reduces the chance that the consumer will contaminate an ophthalmic solution stored in such containers.

EXAMPLE 1

Figure 9:
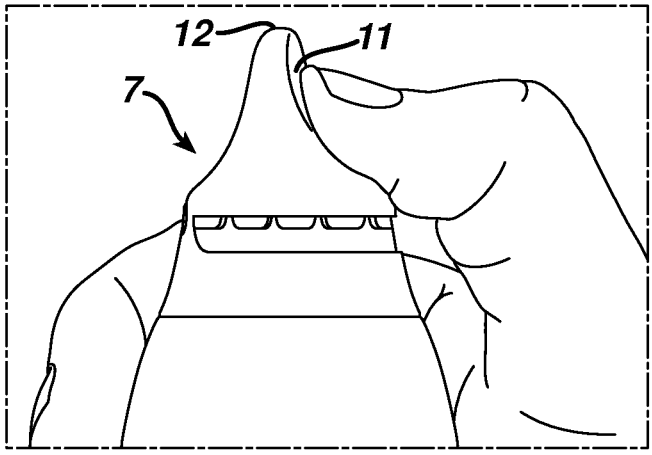
FIG. 9 Angled closure
Figure 10:
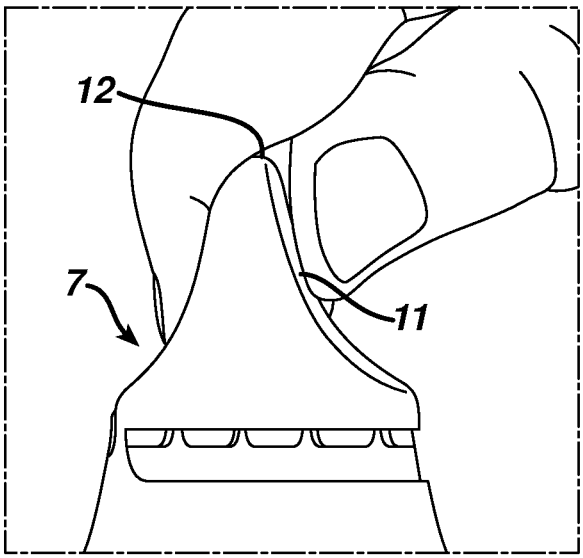
FIG. 10 Angled closure
Figure 11:
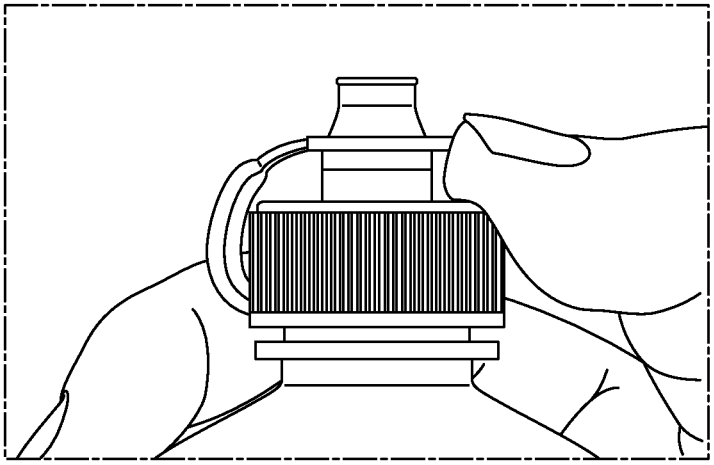
FIG. 11 PRIOR ART
FIG. 11. Button closure
Figure 12:
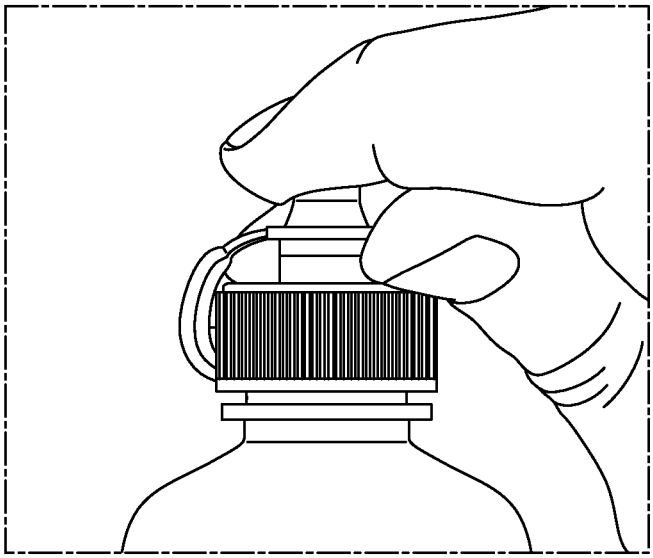
FIG. 12 PRIOR ART
FIG. 12. Button closure

To determine whether bottles closed with the closures of the invention inhibited a user from touching the spout when opening a bottle of contact lens solution, the following test was conducted. The bottles topped with the closures of the invention, FIGS. 9 and 10 ("angled closures) were compared to bottles topped with the most common closures, FIGS. 11 and 12 (button closures). FIGS. 9 and 11 illustrate the "one finger method of opening the bottles and FIGS. 10 and 12 illustrate the two fingered approach for opening the bottles. The bottles were did not contain any solution, and the spout of each bottle was marked with a UV security pen (Dri-Mark Products Inc.) A group of contact lens users washed their hands and were shown open bottles with an angled closures and a button closures and the tester closed the each of bottles in front of the subject to illustrate the general operation. The subjects were instructed to follow their normal lens care routine, but not to remove their lenses. Each subject was evaluated visually by the tester to see bottles, to determine if they touched the spout when they opened the bottles. In addition, after opening each bottle, each subjects hands were evaluated using a UV light to see if any of the marker was transferred to their hand. Ten of the twelve subjects were observed touching the spout when they opened the button closures. Nine of ten of those finding were confirmed by examining the subjects hands with UV light. When the same twelve subjects opening the angled closure, visual evaluation showed that none of them touched the spout when they opening the angles closure. This finding was confirmed by examining their hands UV light.

The foregoing embodiments are only meant to illustrate the invention and not limit it. Those knowledgeable in closures as well as other specialties may find other methods of practicing the invention. However, those methods are deemed to be within the scope of this invention.

What is claimed is:

1. A container and closure system for storing and dispensing a sterilized solution, the container and closure system comprising:

a bottle comprising:
- a body for storing the sterilized solution;
- neck extending from a top portion of said body, said neck comprising:
  - an outer surface;
  - an inner surface; and,
  - a rim defining a bottle opening;

a flip top cap comprising:
- a closure base comprising:
  - a closed top wall;
  - an eccentric spout protruding upwardly from an upper surface of said top wall and having an outlet for dispensing the sterilized solution;
  - a flared exterior skirt extending downwardly from a peripheral edge of said top wall;
  - an interior neck downwardly extending from a lower surface of said top wall, said interior neck having:
    - an outer wall secured to said outer surface of said neck, and
    - an inner wall seated upon said inner surface of said neck;

a pivoting cover comprising:
- a front curvilinear sidewall;
- a rear curvilinear wall;
- a central top wall joining said front curvilinear sidewall to said rear curvilinear sidewall to thereby define an interior cavity;
- a fitting disposed entirely within said interior cavity for closing said outlet of said spout;
- a lower flange for securing said pivoting cover to said peripheral edge of said closure base;

a hinge attaching a peripheral portion of said closed top wall of said closure base to a lower portion of said rear curvilinear wall of said pivoting cover.

2. The container and closure system of claim 1, wherein said fitting extends downwardly from a lower surface of said front curvilinear wall.

3. The container and closure system of claim 1, wherein engaging said front curvilinear wall enables said pivoting cover to pivot about said hinge from a closed position to an open position, and wherein said outlet of said spout is sealed and protected from contamination by said fitting of said pivoting cover when said pivoting cover is oriented in said closed position.

4. The container and closure system of claim 3, wherein said fitting is spaced upwardly and inwardly from said lower flange and said spout is spaced inwardly from said peripheral edge, said fitting and said spout being so arranged to minimize contamination when pivoting said pivoting cover from said closed position to said open position.

* * * * *